US005207775A

United States Patent [19]

Piton et al.

[11] Patent Number: 5,207,775

[45] Date of Patent: May 4, 1993

[54] DEVICE FOR RELEASING AN ANCHOR

[76] Inventors: Claude Piton; Jacqueline Piton, both of 45, rue de Dinan, F-22130 Plancoet, France

[21] Appl. No.: 866,798

[22] Filed: Apr. 8, 1992

[30] Foreign Application Priority Data

Apr. 8, 1991 [FR] France ..... 91 04396

[51] Int. Cl.[5] ..... B63B 21/46

[52] U.S. Cl. ..... 114/299

[58] Field of Search ..... 114/293, 294, 296, 297, 114/298, 299

[56] References Cited

U.S. PATENT DOCUMENTS

| | | | |
|---|---|---|---|
| 3,995,577 | 12/1976 | Gentry | 114/297 |
| 4,721,054 | 1/1988 | Kobayashi | 114/299 |
| 4,836,126 | 6/1989 | Kobayashi | 114/297 |
| 4,848,261 | 7/1989 | Kobayashi | 114/299 |
| 5,074,235 | 12/1991 | Kobayashi | 114/299 |

FOREIGN PATENT DOCUMENTS

| | | | |
|---|---|---|---|
| 2592624 | 7/1987 | France | 114/299 |

*Primary Examiner*—Jesûs D. Sotelo
*Assistant Examiner*—Stephen P. Avila
*Attorney, Agent, or Firm*—Laff, Whitesel Conte & Saret

[57] ABSTRACT

A device for unhooking a main anchor chain (4) from the shank (7) of an anchor (2) makes it possible to release anchor. An elongated plate (10) has one end adpated to receive the last link of the anchor chain (4). The other end of plate (10) has an opening (15) for receiving a shackle (15) on the anchor. A second plate (16) has a finger (17) that covers opening (15) thus making possible the hooking and unhooking of the shackle (6). A tube (29) dropped from the boat runs freely over the main anchor chain (4) to pivot the plates and uncover opening 15. This releases the shackle and therefore the anchor, so that it may be unsnagged.

4 Claims, 7 Drawing Sheets

DEVICE FOR RELEASING AN ANCHOR

The present invention relates to a device for releasing a marine anchor, used to release an anchor caught at the bottom and to permit its raising.

Such devices are known and there will be mentioned, as examples, those described in the documents FR-A-2 592 624, EP-A-254 033 and EP-A-398 740. A device of that type is connected, on one side, to the end of a main anchor chain secured to a boat and, on the other side, a to shackle provided at the free end of the shank of an anchor. A cable also connects said device to the crown of the anchor. When the anchor is caught at the bottom, the main chain is connected to the boat through said device, this enabling the boat to hold in place. These devices comprise a system that is governed either by a cable, or by a tube free to run along the main chain, and that makes it possible for the shackle to get connected to the device. The cable alone is then connected to the main chain and, when pulling the anchor up, one pulls on the crown of the anchor, this making it possible for same easily to become free from the bottom, and therefore to be raised.

The devices described in the above-mentioned documents comprise numerous parts arranged in a complex manner. They are, therefore costly to manufacture and expensive at the sale level.

The purpose of the present invention therefore is to provide a device for releasing a marine anchor, that is simple in structure, therefore cheap to manufacture, and that gives satisfaction as to its operation.

To that end, a releasing device according to the present invention is made up of an elongated piece one end of which is provided to receive the last link of the above-mentioned main chain, and the other end of which is equipped with an opening that opens and is located in the axis of that plate, of a second plate superposed to the first plate, and provided so as to pivot relative to the mentioned first plate, around an axis perpendicular to these plates, said second plate comprising a finger that, in a first relative position of the two plates, covers an end part of said opening thus making possible the hooking of a shackle provided at the free end of the anchor shank and that, in a second relative position, uncovers said end, making possible the unhooking of said shackle. It further comprises a recall spring and a lug piece provided to hold these plates in the mentioned first position when at rest.

Said second plate has, on the one part, a first lateral edge that, in the above first position projects beyond the corresponding lateral edge of the first plate, while being slanted relative to the longitudinal axis of said device and that, in the second position, finds itself above said first plate, and, on the other part, a second lateral edge that is always above the first plate. The first lateral edge of said second plate is brought closer to the opposite edge of said first plate by means of a tube thrown out from the boat and that freely runs along the main chain, this tube having an internal diameter approximately equal to the distance between the first edge of the second plate and the opposite edge of said first plate when said device is in said second position.

Thus, when the tube is thrown over the device, it becomes fixed on the unhooking device, this having as a result to cause the two plates to pivot relative to each other. The finger then clears the opening and thus it disconnects the anchor chain. The anchor then can be raised by means of the cable.

Manufacturing of the device according to the present invention is relatively simple since that device is built around two plates that are easy to shape.

According to another characteristic of the invention, said first plate has, in its lower part where the opening is located, two lateral wings the upper edges of which form lug pieces for the tube when the latter becomes fitted in the device.

According to another characteristic of the invention, the distance between the first lateral edge of the second plate and the corresponding edge of the first plate is greater, at the level of said lug pieces, than the width of the above opening.

According to still another characteristic of the invention, said device comprises a third plate behind the first plate, that is symmetrical relative to the axis of the device.

The characteristics of the invention that have been mentioned above, as well as others, will appear more clearly upon reading of the following description of an example of execution, said description being given in relation to the attached drawing in which:

FIG. 1 mainly shows a boat, an anchor and a releasing device according to the invention.

FIG. 2 is a front view of the device according to the present invention.

FIGS. 3*a* and 3*b* are views that repeat the one in FIG. 1 and that make it possible to illustrate the functioning of the present invention.

Figure 1:
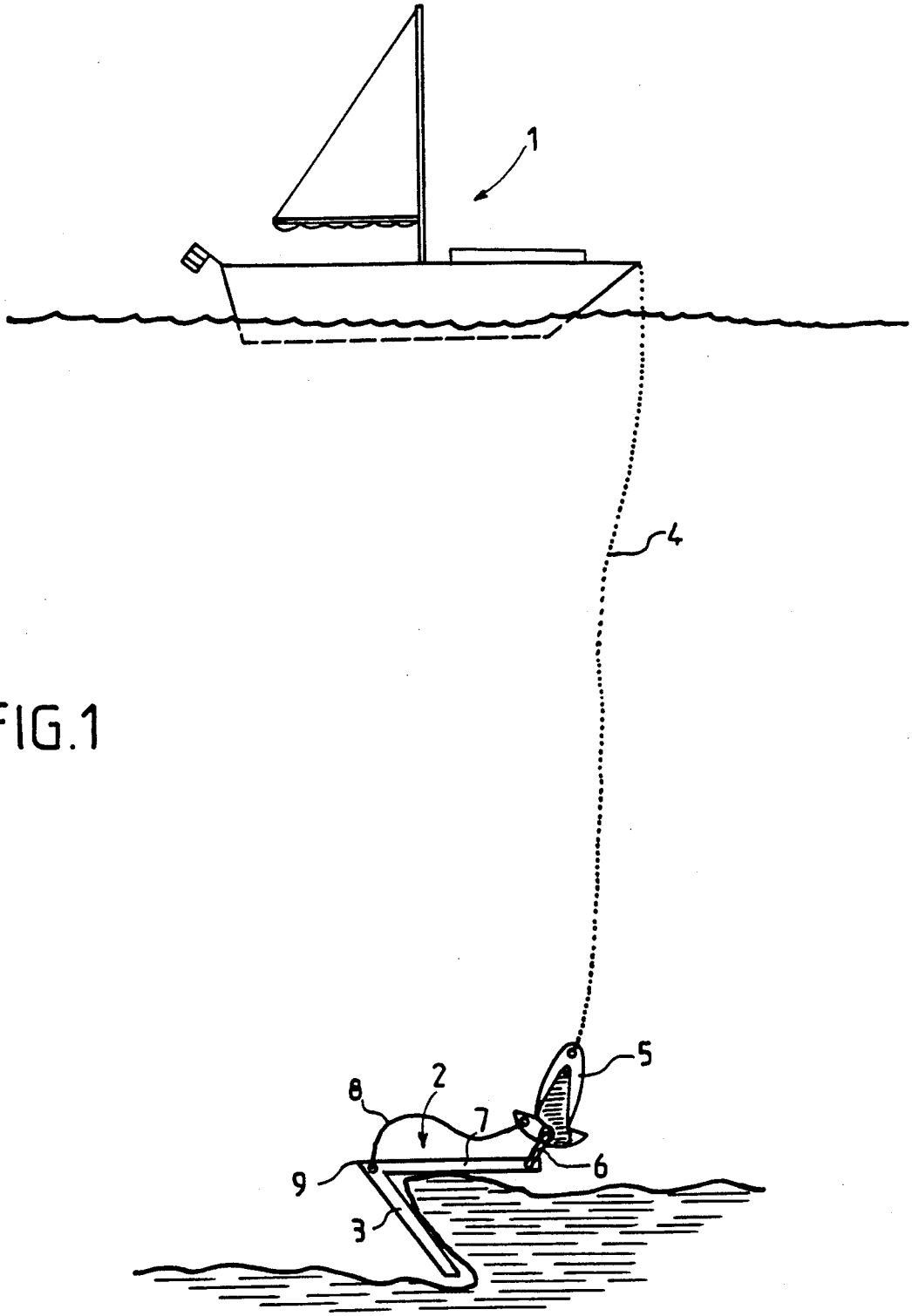

In FIG. 1 there is seen a boat 1 that has lowered its anchor 2. The latter, that may be of any type, is caught at the bottom by at least one of its arms 3. From the boat there runs a main anchor chain 4 the free end of which is connected to a first end of a releasing device 5. The other end of device 5 is connected to a shackle provided at the free end of shank 7 of anchor 2. A cable 8 connects the device 5 to the crown 9 of anchor 2.

Figure 2:
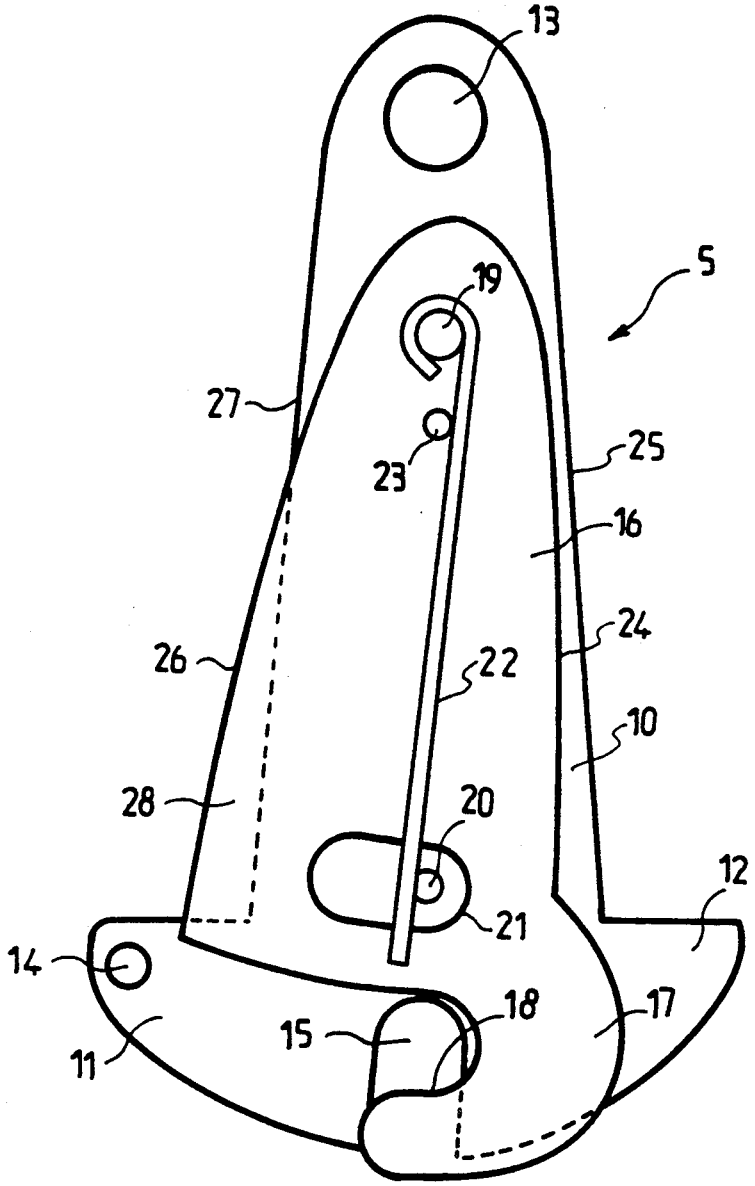

The releasing device 5 that appears in FIG. 1 is shown in detail in FIG. 2. It comprises a first elongated plate 10 approximately triangular in shape with a rounded summit and a widened base to form a part with two wings 11 and 12, and in the shape of an arc of a circle. At the summit of the triangle, there is pierced an opening 13 for passing through of the last link of the main chain 4 (FIG. 1). On wing 11 of the lower part of plate 0, there is pierced an opening 14 in which there is tied the free end of cable 8. Approximately in the axis of device 5 formed by the height from the base of the triangle of the first plate 10 and in the widened part of same, there is provided an opening that opens downwards.

Device 5 comprises also a second plate 16 superposed to the first one and approximately triangular in shape, with a rounded summit and a base in the shape of an arc of a circle. A side adjacent to the base of the triangle of the second plate 16 is extended by a bent finger 17 that forms a hollowed out area 18 approximately perpendicular to the axis of opening 15 and the width of which is approximately equal to the width of the latter.

The summit of the second plate is pieced by a hole provided to receive a shaft 19 perpendicular to the surface of the second plate 16. The first plate 0 also is pierced with a hole that is provided to receive the same shaft 19. The latter is, for example, made up of a bolt, a rivet, a pin or any other equivalent means. It may have, at each one of its ends, two heads (not shown) forming axial lug pieces for each one of the plates 10 and 16. Each plate 10, 16 thus can pivot relative to the other around shaft 19. The position of the holes that receive shaft 19 in each one of the plates 10, 16 and the size of these plates 10 and 16 are such that, during a first relative position of the two plates 10 and 16 , the end of finger 17 can cover the end of opening 15 while being perpendicular to it (as is shown in FIG. 1) and leaving free a passage for the hooking of the shackle 6 (FIG. 1) and that, in a second relative position, the end of finger 27 can clear the end of opening 15 (see FIG. 4) thus permitting the unhooking of shackle 6.

In order to limit the angular displacement of the plates 10 and 16 relative to each other, there is provided a lug piece or pin 20, for example, formed of a rod mounted perpendicular to the surface of the first plate 10 and an oblong hole 21 in the second plate 16, provided to receive said lug piece or pin 20. When the lug piece of pin 20 is hitting against a first end of the oblong hole 21, finger 17 completely covers the end of opening 15. When rod 20 is hitting against the other end of the hole 21, finger 17 completely uncovers the end of opening 15.

A recall spring 22 is provided so that, at rest, the plates 10 and 16 will be positioned, relative to each other, in a first position called the closing position in which finger 17 completely covers the end of light 15. Spring 22 is constituted, in the example of execution shown in FIG. 2, by a flexible rod the ring-shaped end of which surrounds shaft 19, and that is taking its support, by one of its sides, against the pin 20 of the first plate 10 and, by its other side, against a lug piece 23 provided on the second plate 16.

It will be noted that, in that rest position, the lateral edge 24 of the second plate 16, on the side of finger 17, is appreciably parallel to the corresponding edge 25 of the first plate 10 and that it is located within first plate 10. As to the lateral edge 25 of the second plate 16, on the side opposite to that of finger 17, it is located beyond the lateral edge 27 corresponding to the first plate 10. There is thus formed, at rest, a part 28 of the second plate 16 that is not found on the first plate 10.

Figure 3A:
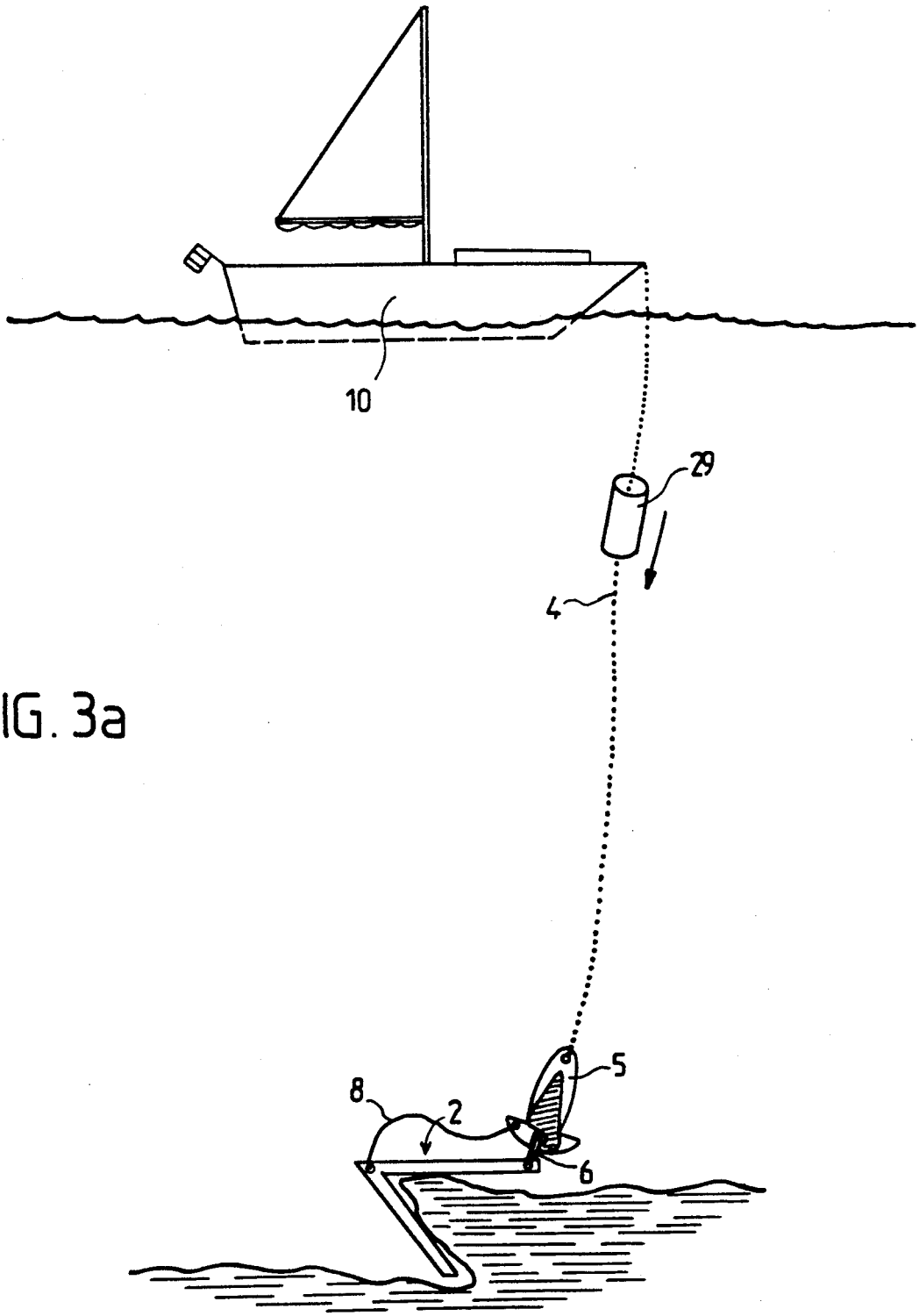
Figure 3B:
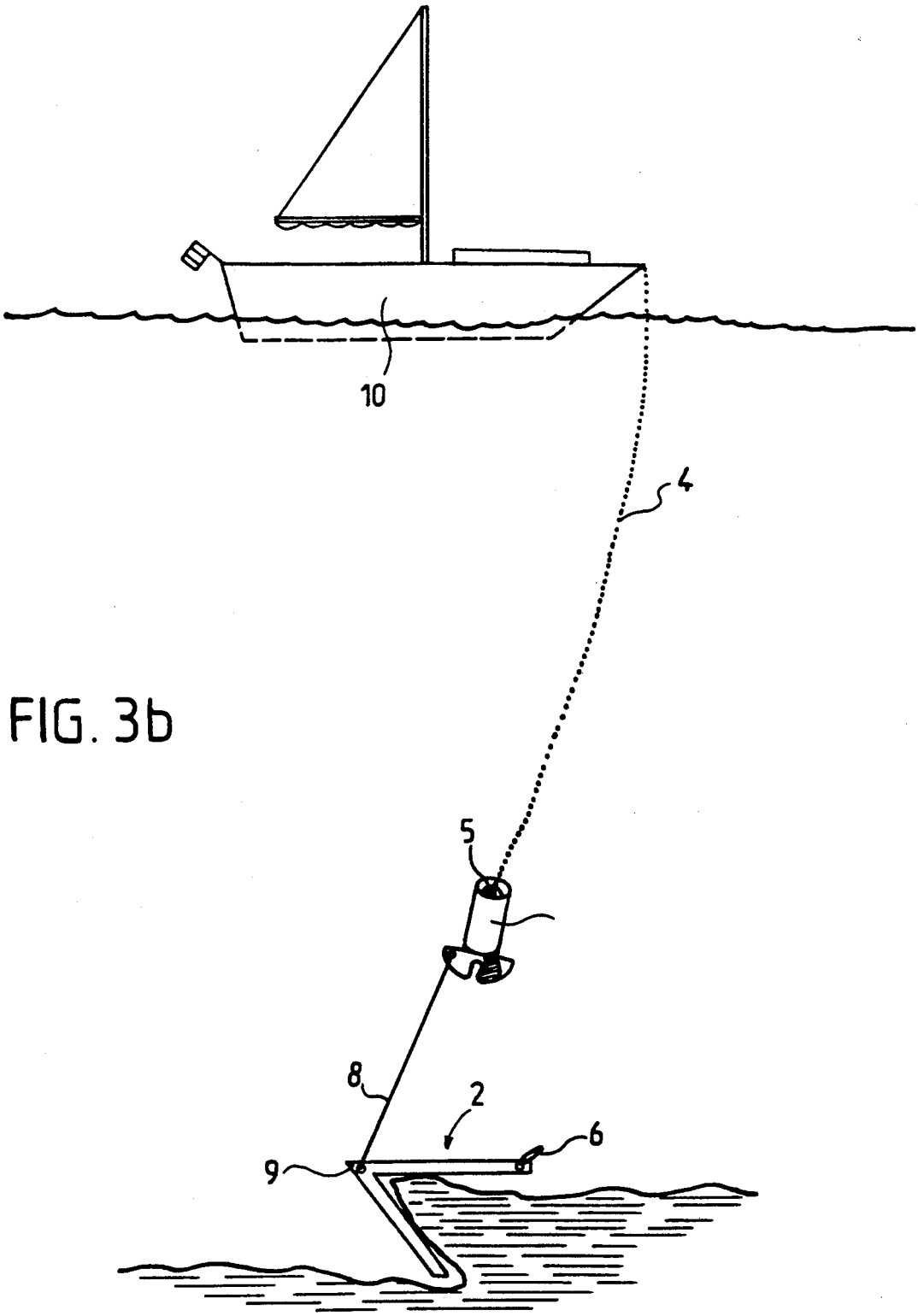

The device 5 operates as follows and as illustrated in FIGS. 3*a* and 3*b* as well as in FIG. 4. When it is desired to raise anchor 2, it is necessary to release it from the bottom. To that end, there is thrown from boat 1 a tube 29 that runs freely over the main chain 4 (FIG. 3*a*). By its own weight the latter fits itself strongly into the releasing device 5 (FIG. 3*b*) that, by acting on the part on the slanted edge 26 of the second plate 16 and on the other part, on the opposite lateral edge 25 of the first plate 10, makes possible the pivoting of one of plates 10 or 16 relative to another plate 16 or 10 When tube 29 has come to stop against the upper edges 30 and 31 of the lower part of the first plate 10 (FIG. 4), the finger 17 no longer covers the end of opening 15 and thus it releases the anchor chain or shackle 6 (FIG. 3*b*).

Figure 4:
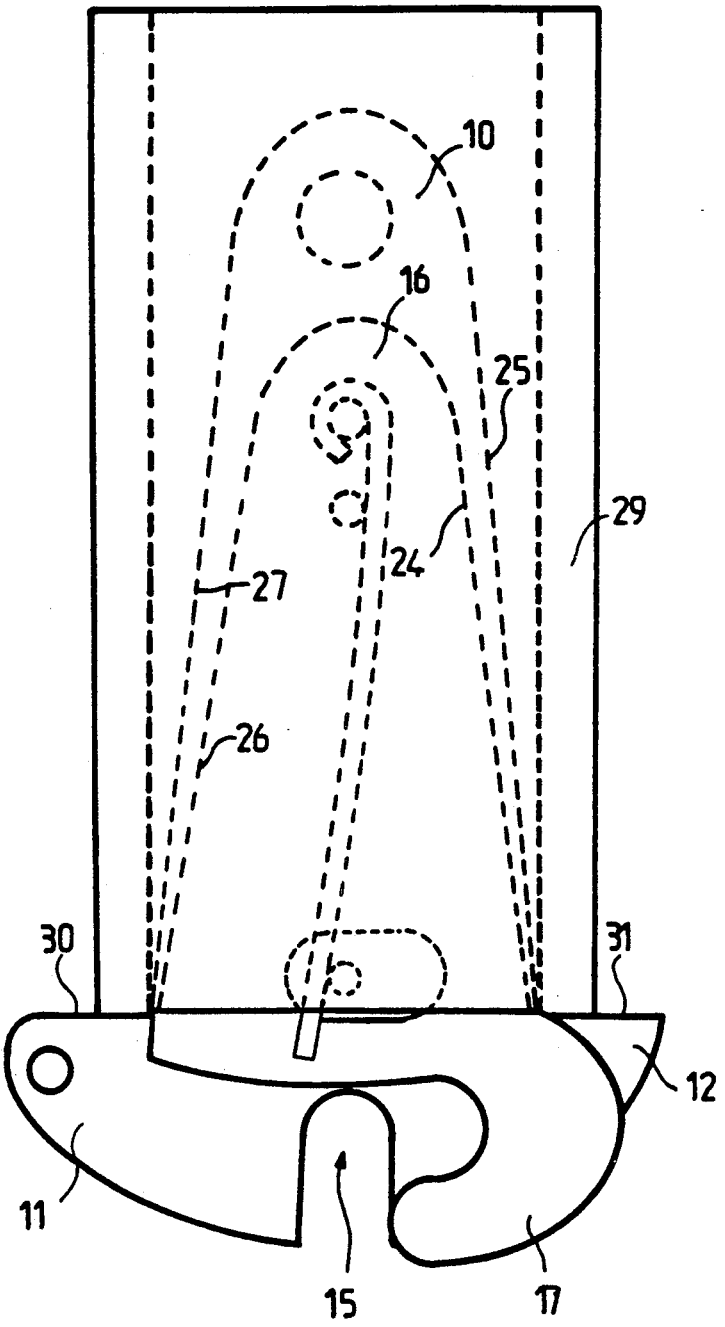
FIG. 4 shows a tube fitted in a device according to the present invention.

In FIG. 4 there is seen tube 29 fitted in the releasing device 5. It can be seen that the internal diameter of tube 29 must have, for a correct operation of device 5, an internal diameter approximately equal to the distance between the two lateral edges 25 and 27 of the first plate 10, at the level of the upper edges 30 and 31 of wings 11, 12, when device 5 is in its open position.

Besides, the distance between the slanted edge 26 of the second plate 16 and the corresponding edge 27 of the first plate 10 at the level of the upper surface of lug piece 30 must be, in the closing position (FIG. 2) greater than the width of opening 15. In that way tube 29, when it is fitted into device 5, makes possible the complete uncovering of opening 15 by finger 17.

It will finally be noted, in FIG. 4, that the lateral edges 24 and 26 of the second plate 16 are, in the open position, within the first plate 10.

For a correct operation of the device according to the invention, tube 29 must have a mass sufficient so that the kinetic energy it acquires when running along the main chain 4, can cause the two plates to pivot relative to each other when it is stopped by the device. That mass may range between 1 and 3 kilograms.

Once the anchor chain or shackle 6 has become separated from the releasing device 5 (FIG. 3*b*), it is by means of the cable 8 and of the main chain 4, through device 5, that there is pulled up, form the boat, the crown 9 of anchor 2. That anchor is thus freed from the bottom and it is possible to raise it.

Figure 5:
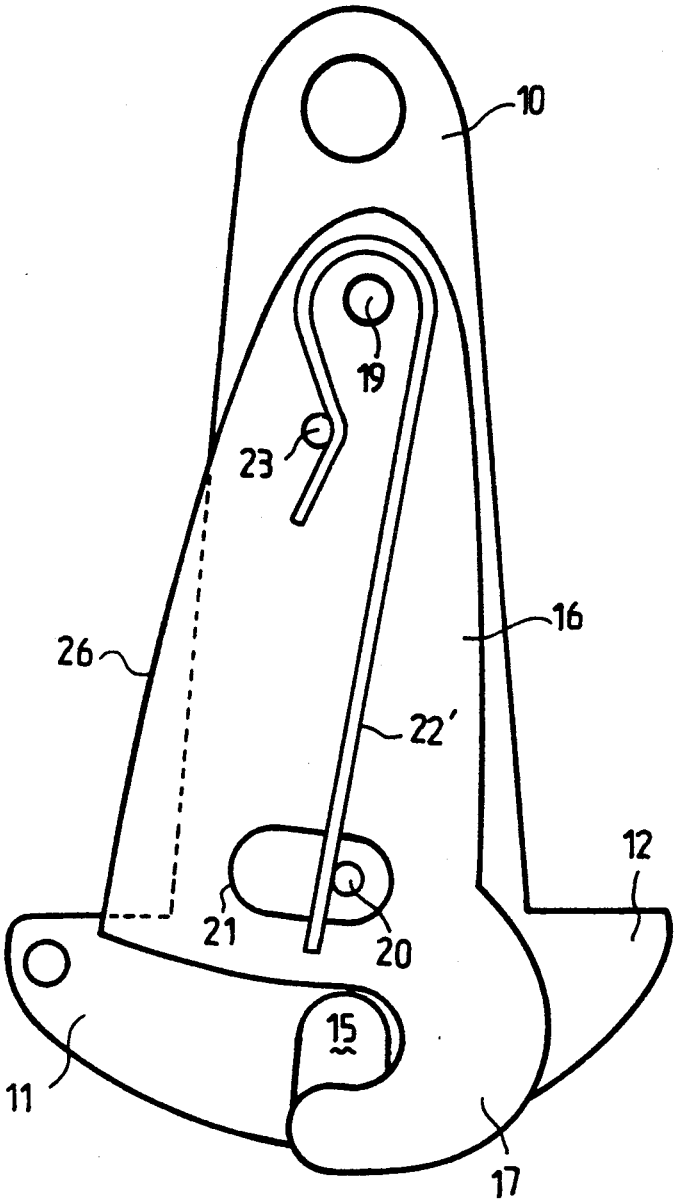
FIG. 5 shows a first variation of execution that comprises a kickover recall spring.

FIG. 5 is a variation of execution in which spring 22' is made up of a pin that surrounds shaft 19 (from the right in FIG. 5), the axis 19 and that takes its support on one side against lug piece 23 formed on the second plate 10 (sic) and on the other side, against the luf piece or pin 19 (sic) coming as one piece with the first plate 10.

Figure 6:
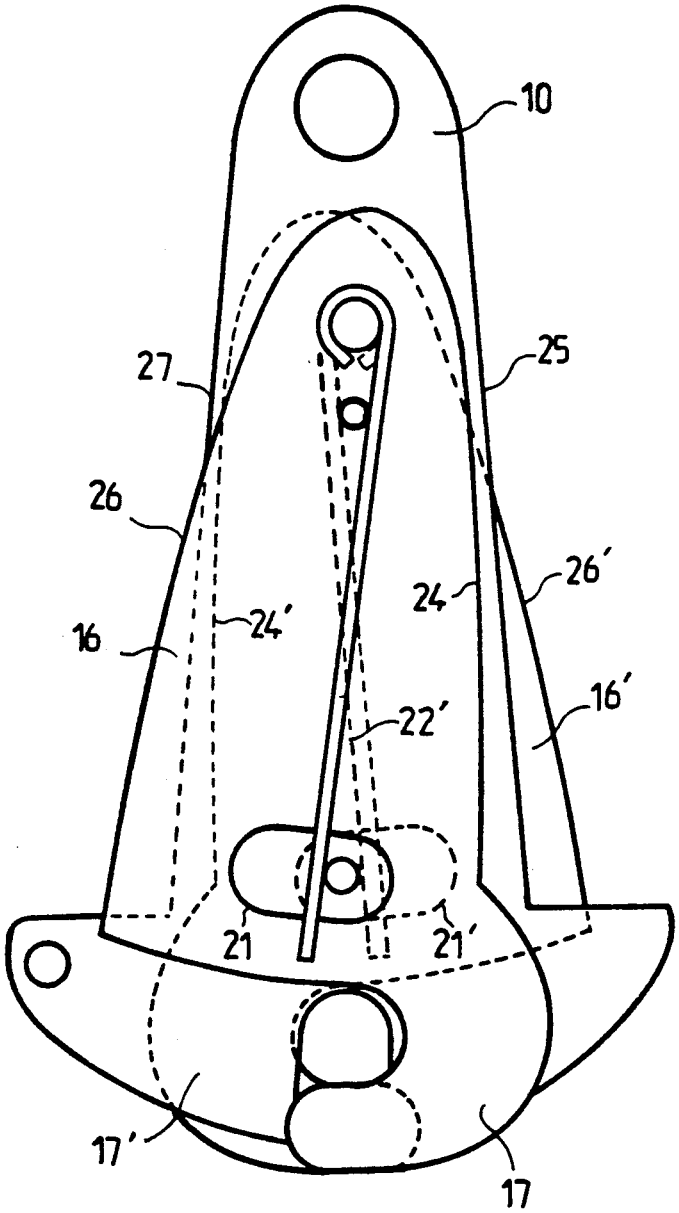
FIG. 6 is a view of a second variation in execution of a device according to the present invention.

FIG. 6 shows a second variation of execution in which a third plate 16, identical with the second plate 16, is symmetrically placed relative to the main vertical axis of the device 5 that is to say behind the first plate 10. A recall spring 22' also is provided to recall the third plate 16' to its rest position. The functioning of that variation of execution is the same as that described above relative to the device 5 in FIG. 5. Its advantage over the latter is found in its higher resistance to opening under the traction forces exerted on the main chain 4.

It will be noted in FIG. 6 that the elements of the third plate 16' have the same reference markings as the same elements of the second plate 16, but that a sign prime has been added to them.

We claim:

1. A device for the unhooking a main chain (4) from a free end of a shank (7) of an anchor (2) that makes it possible to release said anchor (2) by pulling it by means of a cable (8) connected to one side of an anchor crown (9) said device comprising an elongated first plate (10) having one end which receives a main chain (4), means on the other end of said plate 10 including an opening (15) that is located substantially on an axis of said plate (10), a second plate (16) superimposed on and pivotally attached to the first plate (10) said second plate (16) having a part (17) that covers an open end part of said opening (15) when said first and second plates (10, 16) are in a first mutual position, thus making it possible to hook a shackle (6) at a free end of the shank (7) of anchor (2), said first and second plates (10, 16) in a second mutual position uncovering said open end part for unhooking said shackle (6), means comprising a spring (22) (2) for normally holding said plates (10, 16) in said first mutual position, said second plate (16) having a first lateral edge (26) that projects beyond a corresponding lateral edge (27) of the first plate (10) when said plates are in said first mutual position and which is juxtaposed over said corresponding lateral edge when in said second mutual position, and tube means (29) for freely sliding down said main chain, said tube means engaging the first lateral edge of said second plate (16) to bring it closer to the corresponding lateral edge (27) of said first plate (10), the internal diameter of said tube (29) forcing the first edge (26) of the second plate (16) and the corresponding edge (27) of said first plate (10) into said second mutual position for releasing said shackle (6).

2. A device according to claim 1 wherein said lower part of said first plate (10) where said opening (15) is located forms two lateral wings, the upper edges (30 and 31) of said wings (11, 12) forming lug pieces for stopping the tube means (29) when it comes to rest at the bottom of said main chain.

3. A device according to claim 2 wherein the distance between the first lateral edge (26) of the second plate (16) and the corresponding edge (27) of the first plate (10) at the level of said lug pieces (20 and 31), is greater than the width of said opening (15).

4. A device according claim 3 and a third plate (16') adjacent the first plate (10) and symmetrical relative to an axis of the device.

* * * * *